United States Patent [19]

Göpel

[11] 4,098,250

[45] Jul. 4, 1978

[54] SUCTION LINE FORMATION OF COMBUSTION ENGINES

[76] Inventor: Theo Göpel, Fraustadtstrasse 13, D-8000 Munich 40, Fed. Rep. of Germany

[21] Appl. No.: 688,954

[22] Filed: May 24, 1976

[30] Foreign Application Priority Data

Jun. 4, 1975 [DE] Fed. Rep. of Germany ..... 2524772

[51] Int. Cl.[2] ..... F02M 29/00

[52] U.S. Cl. ..... 123/141; 48/180 B; 123/52 M

[58] Field of Search ..... 123/141, 142, 52 M; 48/180 R, 180 B

[56] References Cited

U.S. PATENT DOCUMENTS

| | | | |
|---|---|---|---|
| 1,133,528 | 3/1915 | Bennett | 123/52 M |
| 1,333,142 | 3/1920 | Ulmer | 123/52 M |
| 1,960,775 | 5/1934 | Fisher et al. | 123/52 M |
| 2,016,694 | 10/1935 | Timian | 123/52 M |
| 2,066,923 | 1/1937 | Wolfard | 123/52 M |
| 2,175,428 | 10/1939 | Charles | 123/52 M |
| 2,241,461 | 5/1941 | Jacoby | 123/52 M |
| 2,580,706 | 1/1952 | Trisler | 123/52 M |
| 3,874,357 | 4/1975 | List et al. | 123/141 X |
| 3,930,473 | 1/1976 | McFarland | 123/52 M |
| 3,930,485 | 1/1976 | Konomi | 123/141 |

*Primary Examiner*—Ira S. Lazarus

[57] ABSTRACT

On the suction line (10) and on top of it of an internal combustion engine, particularly an Otto motor, between the carburetor and the inlet valve of the cylinder head, a vortex chamber (12) is placed providing for an element (14) producing vortices and reducing the cross-section of the suction line which element is for instance in the form of a plate, approximately two-thirds of the vortex chamber cross-sections on the suction side being covered, one-third being open.

The evaporated or gasified fuel air mixture coming from the carburetor in the region of the plate is disrupted and is whirled and partly sucked into the vortex chamber. The degree of combustion and the efficiency of the engine is increased in a substantial manner.

6 Claims, 4 Drawing Figures

SUCTION LINE FORMATION OF COMBUSTION ENGINES

The invention relates to the formation of the suction line of internal combustion engines, particularly Otto engines, between the carburetor and the inlet valve.

As is generally known, carburation in today's carburetors — which to the greater part are plain tube carburetors — is effected but in an uncomplete way: the liquid not carbureted or not evaporated remainder, in the form of droplets and in the form of a stream is entrained along at the suction pipeline by the air to the inlet valves. Moreover, a great part of the gasoline precipitates in liquid form again.

It is the object of the invention to obtain a substantially improve atomization of the fuel in the fuel-air-mixture in the suction line leading to a better efficiency of the engine.

In a surprisingly simple way according to the invention this is achieved by an arrangement of a vortex chamber at the suction line which at least in part opens towards the suction line.

By the vorticity effected thereby a fine atomization is brought about. The combustion in the cylinder is improved, thus the gasoline is better exploited and produces higher combustion efficiency, which fact again will lead to less toxic exhaust gases.

In order to obviate to the largest possible extent condensation of the gasoline in the region of the vortex chamber, advantageously the vortex chambers are arranged at the top of the suction line.

According to a preferred embodiment the vortex chamber provides for a vortex constricting means projecting into the suction line, which constricting means is arranged obliquely to the axis of the suction line.

It is of particular advantage, if the vortex chamber is arranged as close to the cylinder head and as close to the inlet valve as is possible from the construction point of view.

The vortex constricting can cover the entrance into the vortex chamber to an extent of approximately two-thirds such that approximately one-third of free cross-section will remain for the entrance of the fuel air mixture.

Generally, the vortex constricting which is in the form of a plate will extend transversely over a horizontal cross-section between opposite walls of the suction line.

The height of the vortex chamber is not greater than the diameter of the suction line and mostly is chosen approximately equal to it. In case the suction line and the vortex chamber are not round, but are of oval or cornered form, it equally applies that the height of the vortex chamber approximately corresponds to the biggest dimension of the suction line cross-section.

Conveniently, the vortex chamber and the vortex constricting means together with the suction elbow are cast as one piece.

Seen from the suction line, the vortex constricting means projects into its cross-section to such an extent that a constriction of the cross-section of between 15 to 30%, advantageously of 20%, will result.

The vortex constricting means can be constituted by a plate, or a wedge; laterally it can contact the suction line and at its free end can be straight or round. If a particular increase of vorticity is to be produced, the edge can be of pointed form.

As an example, purely schematic embodiments of the invention now are to be illustrated with reference to the attached drawing in which.

Figure 1:
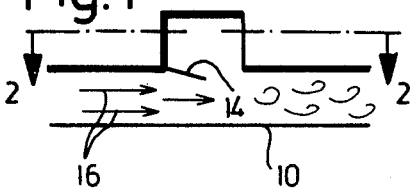
FIG. 1 shows a suction line with vortex chamber according to the invention.

On the suction line 10 and on top of it according to FIG. 1 a vortex-chamber 12 is arranged, which opens towards the suction line. From the leading edge of the vortex chamber 12 a vortex constricting means 14 extends obliquely downwardly against the axis of the suction line.

The evaporated or gasified fuel-air mixture entering in laminar flow by means of the constriction by breaking of even flow pattern at the edge of the vortex constricting means 14 and by the presence of the vortex chamber 12 becomes particularly whirled and at 18 flows off in a state of good vorticity.

Figure 2:
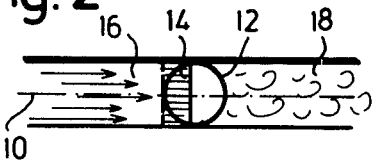
FIG. 2 is a section along line 2—2 in FIG. 1.

In FIG. 2, which is a section through FIG. 1, in plan view it is recognized that the vortex constricting means 14 is in the form of a plate and extends between the side walls of the suction line.

It is also possible, however, to have the beginning of the vortex constricting means follow the curvature of the vortex chamber so that the flow will hit a succeeding bent portion of the vortex constricting means 14 bent according to the suction line and according to the vortex chamber, which constricting means at the flow-off side for instance can be of straight form again.

Figure 3:
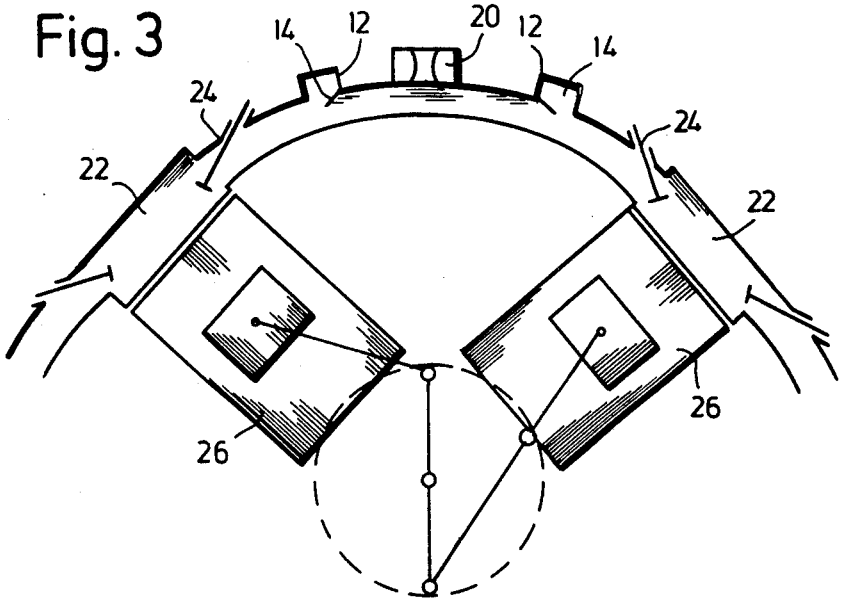
FIG. 3 shows an example-like application to a radial engine.

FIG. 3 shows an embodiment as applied to a V-motor, particularly a V-8-motor, it being recognized that from the constructive point of view the vortex chambers 14 are arranged as close as possible to the cylinder heads 22 of the cylinder 26 respectively as close as possible to the inlet valves 24. No reference numerals have been given to the outlet valves as this does not seem necessary in this connection. The mixture coming from the carburetor 20 is distributed uniformly to both sides and is influenced by a vortex chamber 14 respectively. Thus one vortex chamber is provided for every cylinder head, a V-8-motor in a manner known per se being provided with two carburetors.

Figure 4:
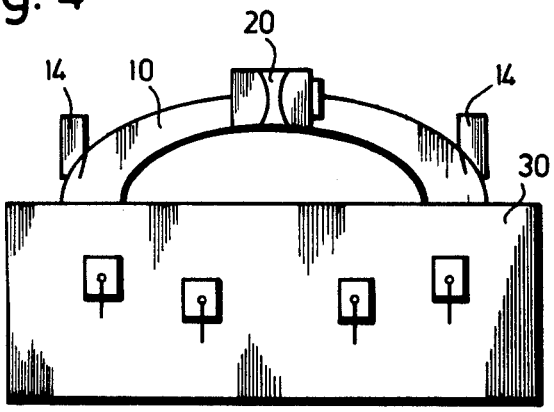
FIG. 4 shows an example of application to an in-line engine.

FIG. 4 shows an in-line engine it being recognized again that the vortex chambers are arranged close to the cylinder heads of the in-line motor 30 which only schematically is shown.

Modifications and alterations are within the scope of the invention.

In a practical realization of the invention with a middle class car (Opel), it was possible to reduce the gasoline consumption by a liter for 100 km.

I claim:

1. Suction line formation for internal combustion engines, particularly Otto engines, arranged between a carburetor and the inlet valve of the engine, comprising:

a closed end vortex chamber disposed on top of and protruding outwardly from the engine fuel suction line and having an open end directed at least in part into the suction line, and a vortex constricting means extending from a leading edge of the opening of said vortex chamber and projecting downwardly and obliquely into the suction line for increasing vorticity in the fuel-air mixture passing through said suction line.

2. The suction line formation according to claim 1, wherein said vortex constricting means comprises a plate having a pointed edge.

3. The suction line formation according to claim 1, wherein said vortex chamber is arranged as close as possible, construction wise, to the inlet valve of the engine.

4. The suction line formation according to claim 1, wherein the height of said vortex chamber is substantially equal to the vertical dimension of the suction line.

5. The suction line formation according to claim 1, wherein said vortex constricting means covers approximately two-thirds of the open-end cross-section of said vortex chamber.

6. The suction line formation according to claim 1, wherein said vortex constricting means conprises a plate extending between side walls of the suction line.

* * * * *